US010507372B1

(12) United States Patent
Dickerson

(10) Patent No.: US 10,507,372 B1
(45) **Date of Patent: *Dec. 17, 2019**

(54) SPORTS BALL REBOUNDER NET

(71) Applicant: Rukket, LLC, Wilmington, DE (US)

(72) Inventor: Ryan L. Dickerson, Athens, GA (US)

(73) Assignee: Rukket, LLC, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/210,607

(22) Filed: Dec. 5, 2018

Related U.S. Application Data

(63) Continuation of application No. 15/957,146, filed on Apr. 19, 2018, now Pat. No. 10,166,453.

(60) Provisional application No. 62/538,904, filed on Jul. 31, 2017.

(51) Int. Cl.
*A63B 69/00* (2006.01)
*A63B 63/00* (2006.01)
*A63B 102/18* (2015.01)

(52) U.S. Cl.
CPC ..... *A63B 69/0097* (2013.01); *A63B 63/004* (2013.01); *A63B 69/0002* (2013.01); *A63B 2063/001* (2013.01); *A63B 2069/0006* (2013.01); *A63B 2069/0011* (2013.01); *A63B 2102/18* (2015.10); *A63B 2102/182* (2015.10)

(58) Field of Classification Search
CPC ..... A63B 69/0097; A63B 63/004; A63B 69/0002; A63B 2102/18; A63B 2102/182; A63B 2063/001; A63B 2069/0006; A63B 2069/0011; A63B 63/00
USPC ..... 473/435, 422, 454, 194, 197, 434, 431, 473/446, 456; 273/383, 407, 395, 410, 273/400, 396; D21/705, 698
See application file for complete search history.

(56) References Cited

U.S. PATENT DOCUMENTS

| | | | |
|---|---|---|---|
| 2,944,816 | A | 7/1960 | Dixon |
| 3,427,026 | A | 2/1969 | Mahoney |
| 3,672,672 | A | 6/1972 | Rubin |
| 3,706,451 | A | 12/1972 | Dixon |
| 3,828,033 | A | 8/1974 | Nelson |
| 3,963,240 | A | 6/1976 | Tidwell |

(Continued)

OTHER PUBLICATIONS

Champion Deluxe Pitch Back Screen (BN4272), www.amazon.com/champion-sports-multi-sport-pitch-screen, downloaded Apr. 19, 2018.

(Continued)

*Primary Examiner* — Mitra Aryanpour
(74) *Attorney, Agent, or Firm* — Rogowski Law LLC

(57) ABSTRACT

A sports ball rebounder net has a rebound surface positioned and angled to receive balls and to return or propel those projected balls back to the athlete. The net frame has brackets extending from the rear of each vertical post. The brackets each have an arcuate hole at a first radial distance from a center of rotation, and a series of spaced apart holes along an arc located at a second distance from the center of rotation. One arm of the back support is connected to the first bracket and a second arm connected to the second bracket, each at the respective centers of rotation. The angular position of the back support in respect of the net frame is adjusted by pulling a cord that is attached at each end to a respective plunger associated with each arm of the back support, each of which has a pin that is retracted upon pulling the cord. The respective pins of the plungers mate with one of each series of holes through the bracket attached to the net frame.

19 Claims, 10 Drawing Sheets

(56) References Cited

U.S. PATENT DOCUMENTS

| | | | |
|---|---|---|---|
| 4,239,235 | A | 12/1980 | Torres |
| 4,456,251 | A | 6/1984 | Balaz |
| 4,553,751 | A | 11/1985 | Ketchum |
| 4,932,657 | A | 6/1990 | Hailer |
| 5,772,537 | A | 6/1998 | Anderson |
| 5,833,234 | A | 11/1998 | Vavala |
| 5,906,551 | A | 5/1999 | Padilla |
| 6,739,988 | B2 | 5/2004 | Jensen |
| 6,880,828 | B2 | 4/2005 | Liao |
| 6,935,971 | B2 | 8/2005 | Piras |
| 7,704,169 | B1 | 4/2010 | Bove |
| 8,590,902 | B2 | 11/2013 | Goldwitz |
| 8,651,979 | B2 | 2/2014 | Chen |
| D805,591 | S | 12/2017 | Miller |
| 2003/0060309 | A1 | 3/2003 | Smith |
| 2007/0090601 | A1 | 4/2007 | Liao |
| 2008/0067751 | A1 | 3/2008 | Hunt |

OTHER PUBLICATIONS

SKLZ Pitchback Baseball Trainer for Throwing, Pitching and Fielding, www.amazon.com/dp/B003D6FDBY, downloaded Apr. 19, 2016.

SPORTS BALL REBOUNDER NET

CROSS-REFERENCE TO RELATED APPLICATIONS

This application claims priority under 35 USC § 120 to U.S. patent application Ser. No. 15/957,146, which claimed priority under 35 USC § 119(e) to U.S. Provisional Application Ser. No. 62/538,904, entitled "Sports Ball Rebounder Net", filed Jul. 31, 2017, the disclosures of each of which are incorporated by reference herein.

FIELD OF THE INVENTION

The present invention is generally directed to ball pitching and kicking practice nets under tension to rebound a ball to the user.

BACKGROUND OF THE INVENTION

Many different sports require athletes to master skills of passing and catching a ball before the athletes can effectively compete in their sport or physical activity, such as baseball, soccer, softball and basketball. Typically, several athletes will practice together to hone their skills in the particular sport or activity they wish to play. Many times, however, it may be difficult to find a partner to practice passing or catching a ball.

A number of devices have been developed to allow an individual athlete to practice passing, throwing, pitching, kicking, hitting and catching a ball alone. Some of these devices provide a vertical surface toward which an athlete can throw or pass a ball. The vertical rebound surface typically functions as a backstop and, in some cases, is capable of returning or rebounding the ball at least a portion of the distance back to the user. In other cases, the elastic nature of the ball may contribute or allow the ball to be returned at least a portion of the distance back to the athlete. These devices are designed to accommodate a somewhat horizontal movement of the ball through the air and rarely return the ball back to the athlete with enough force to allow the users to practice their catching and reaction skills related to the specific sport or activity at hand.

Some rebounding surfaces may be adjusted from vertical by setting a different angle between the frame supporting the net and the brace frame or legs. Some rebounding frames require screw fasteners to be removed and reinserted into brackets to adjust the angle of the rebound frame. Pieces can be lost and aligning fasteners with holes in multiple parts can be difficult.

Improvements to pitching and kicking practice nets continue to be sought.

BRIEF SUMMARY OF THE INVENTION

In a first embodiment of the invention, a sports ball rebounder net has a frame with at least two side posts, a top bar and a bottom bar or base. A net is suspended within the frame. Preferably, the net is joined to the frame with elastic bands with each elastic band further secured by a hook. A back support is adapted to maintain the frame in a desired set of positions at one or more angles from horizontal over a ground or support surface.

The back support has a first arm and a second arm and a base between the first arm and second arm. The proximal end of the first arm is removably joined to a first bracket depending from a first of the at least two side posts. The first bracket defines a pivot and has two or more holes therethrough spaced apart from the pivot. The proximal end of the second arm is removably joined to a second bracket depending from a second of the at least two side posts. The second bracket defines a pivot and has two or more holes therethrough spaced apart from the pivot. A first plunger is associated with the first of the back support arms. The first plunger retractably deploys a first pin to engage with one hole of the two or more holes of the first bracket. A second plunger is associated with the second of the back support arms. The second plunger retractably deploys a second pin to engage with one hole of the two or more holes of the second bracket.

A cord directly or indirectly is joined at one end to the first plunger and at its opposite end to the second plunger. The cord preferably has a length that is longer than the distance between the two side posts of the frame. A handle may be formed in or attached to the cord, preferably at or near the mid-point along the length of the cord. The cord is adapted to be pulled to retract the first pin and the second pin out of the holes of the first and second brackets. By pulling on the cord, the pins in the plungers are drawn out of the holes of the first and second brackets so that the angular orientation of the first and second arms of the back support can be adjusted to one or more ball rebounding positions and/or to a storage position.

In one advantageous embodiment, the first plunger comprises a first attachment adapted for linking to the cord, and the first attachment is welded to the first pin. The second plunger comprises a second attachment adapted for linking to the cord, and the second attachment is welded to the second pin.

In one particularly preferred embodiment, the first arm of the back support is joined for pivotable movement to the pivot of the first bracket with a fastener, and the second arm of the back support is joined for pivotable movement to the pivot of the second bracket with a fastener.

In another preferred embodiment, the first bracket further defines a first arcuate slot or hole positioned between the first bracket pivot and the two or more holes of the first bracket, and the second bracket further defines a second arcuate slot or hole positioned between the second bracket pivot and the two or more holes of the second bracket. A first projection or fastener extends from the first arm of the back support and into the first arcuate slot or hole, and a second projection or fastener extends from the second arm of the back support and into the second arcuate slot or hole.

Optionally, one or more frictional engagement bands is/are appended to the base adapted for contact with a ground or support surface. Moreover, the back support may have a base, and one or more frictional engagement bands may be appended to such base of the back support adapted for contact with a ground or support surface.

BRIEF DESCRIPTION OF THE DRAWINGS

The foregoing summary, as well as the following detailed description of the disclosure, will be better understood when read in conjunction with the appended drawings. For the purpose of illustrating the disclosure, there is shown in the drawings embodiments of sports ball rebounder nets which are presently preferred. It should be understood, however, that the disclosure is not limited to the precise arrangements and instrumentalities shown. In the drawings.

DESCRIPTION OF THE DISCLOSURE

Figure 1:
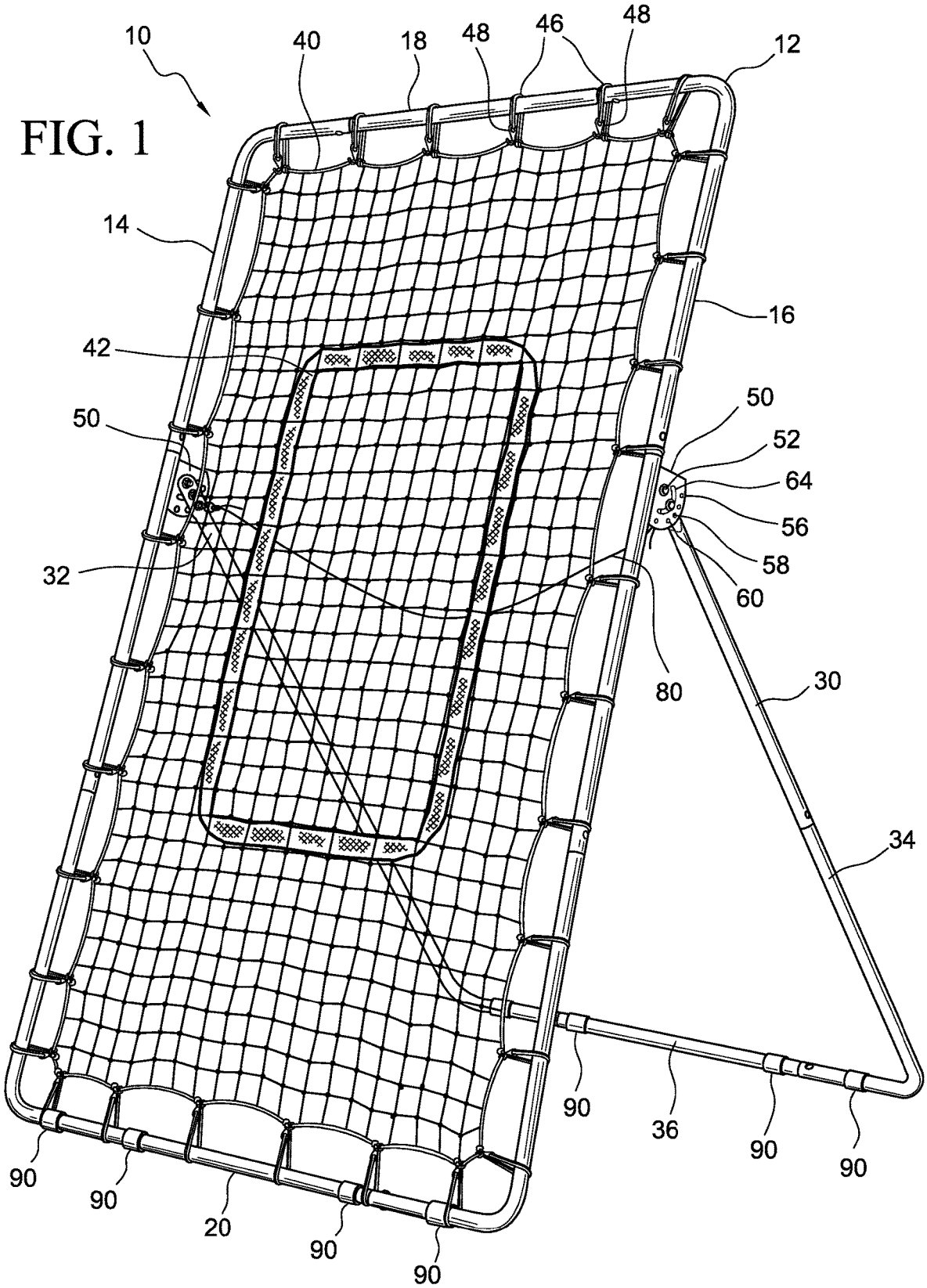
FIG. 1 is a right front perspective view of a ball rebounding practice net of a first embodiment standing at a first angle from vertical.
Figure 2:
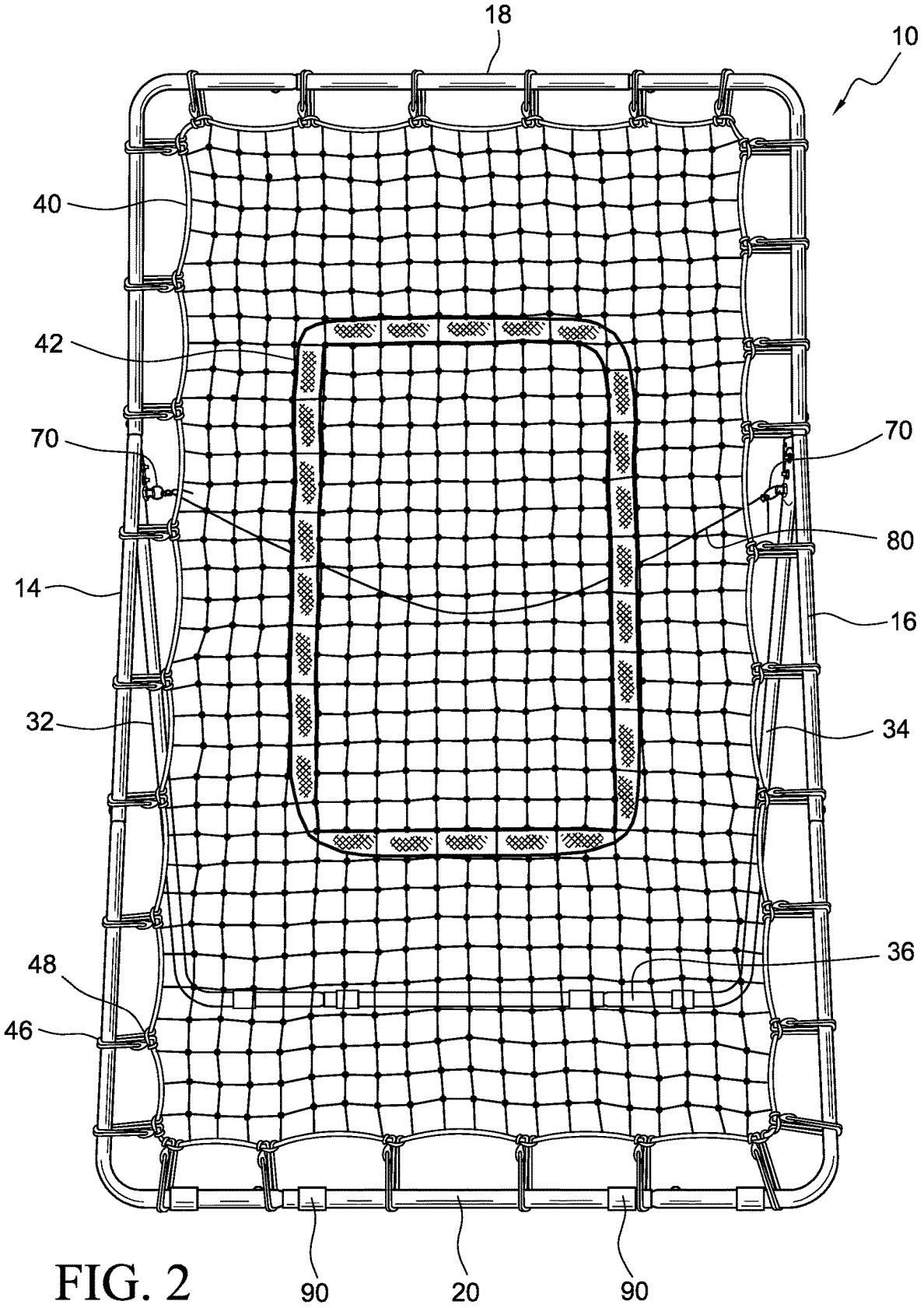
FIG. 2 is a front elevational view of the ball rebounding practice net of FIG. 1.

Certain terminology is used in the following description for convenience only and is not limiting. Unless specifically set forth herein, the terms "a," "an" and "the" are not limited to one element, but instead should be read as meaning "at least one." The terminology includes the words noted above, derivatives thereof and words of similar import.

It also should be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Referring to the drawings in detail, FIGS. 1-6 show a first embodiment of a sports rebounder net 10 having a metal frame 12 comprising a base 20, a top 18 and two side posts 14, 16 forming a rectangle. A net 40 is suspended from the frame 12. In this embodiment, the net 40 is attached using bungie cord elastic bands 46 wrapped around the metal posts 14, 16, 18, 20 forming the frame 12 and joined together with hooks 48. Preferably, the base 20 has silicone or other frictional engagement material banded around the base post to function as feet 90. The feet 90 keep the bungie cords 46 that attach the net 40 to the base 20 from rubbing on the ground, preventing fraying of the net and bungie cords and scratches from forming in the base. The feet 90 better support the base 20 on the ground to prevent movement on a smooth surface such as a gym floor or basketball court. The feet 90 also better prevent the base 20 and hooks 48 holding the bungie cords 46 of the net 40 from scratching a gym floor or basketball court.

The net 40 in the embodiment shown has a target area 42 delineated by tape or ribbon woven into or applied onto a center portion of the net 40. If the net 40 is impacted by a ball within the target area 42, the net will spring back to rebound the ball toward the thrower. The net 40 comprises a woven square mesh of nylon roping or nylon string with mesh openings of about one-half to one inch on all sides.

Figure 3:
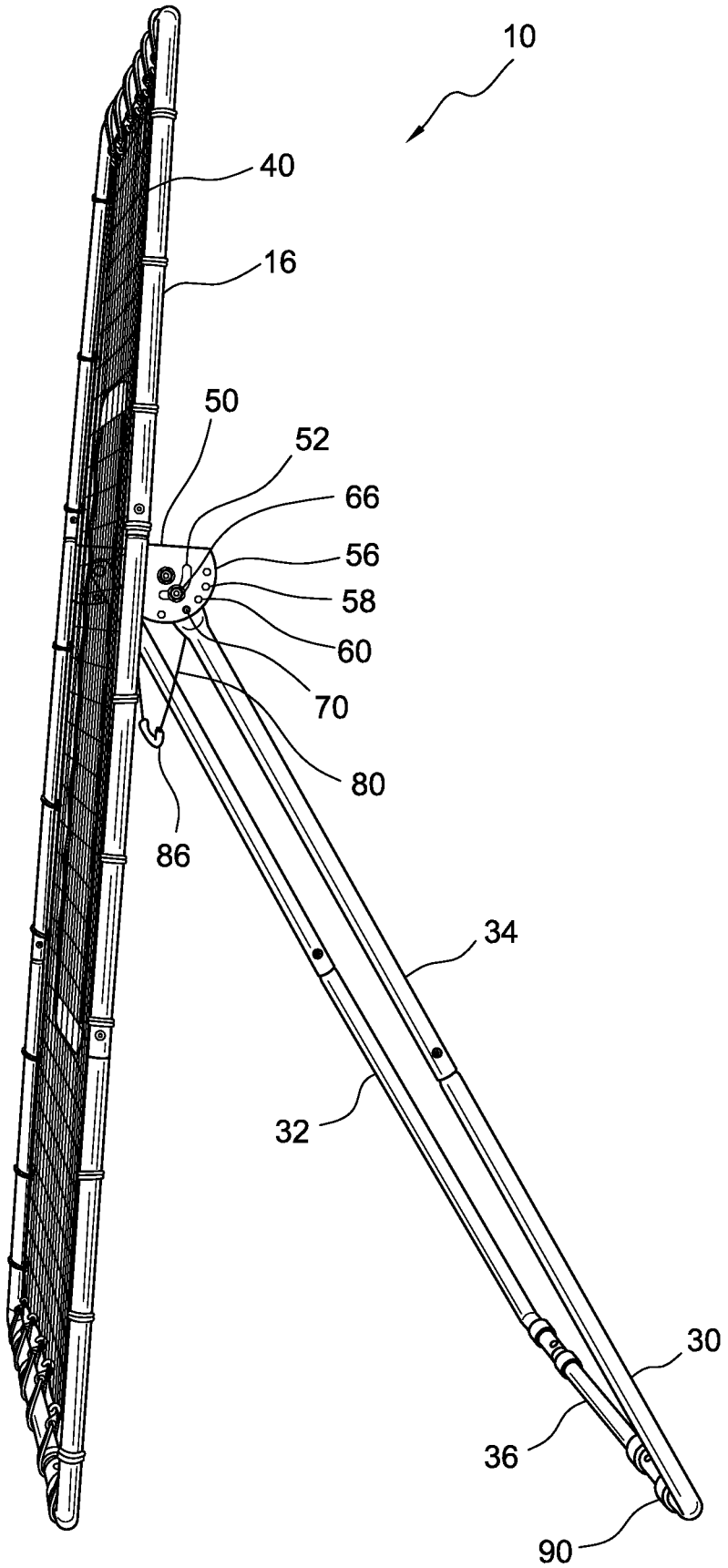
FIG. 3 is a right side elevational view of the ball rebounding practice net of FIG. 1.
Figure 4:
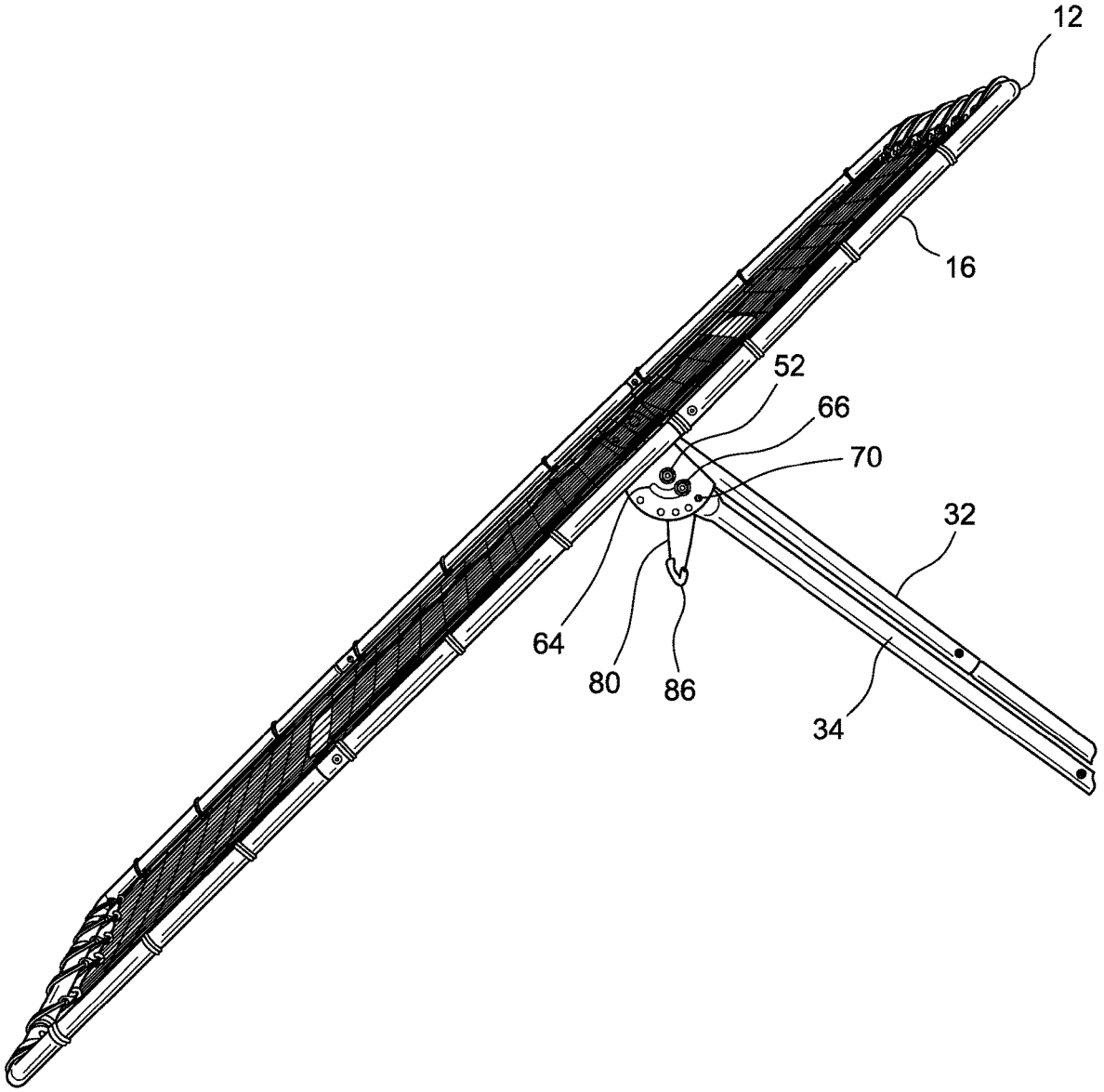
FIG. 4 is a right side elevational view of the ball rebounding practice net of FIG. 1 in which the net surface is held at a second angle from vertical.

The back support 30 is angularly adjustable with respect to the frame 12, so as to change the angle of the frame 12 from a storage position (See FIG. 5) to one or more rebounding positions (Compare FIGS. 3 and 4). Brackets 50 extend from the rear side of the side posts 14, 16 of the frame 12. The arms 32, 34 of the back support are secured to the brackets 50 for pivotable rotation at the pivot points 52 on the brackets 50. In each bracket 50, spaced apart from the pivot point 52, are an arcuate segment hole 64 at a first radial distance, and a series of holes 56, 58, 60 in an arcuate array at a second distance from the pivot point 52. The brackets 50 in the embodiments shown herein have five holes, but there can be as few as two and as many beyond five holes as desired. A projection 66 from each arm 32, 34 of the back support 30 is inserted into a respective arcuate segment hole 64 to support the pivotable movement of the back support 30 in respect to the frame 12.

Figure 6:
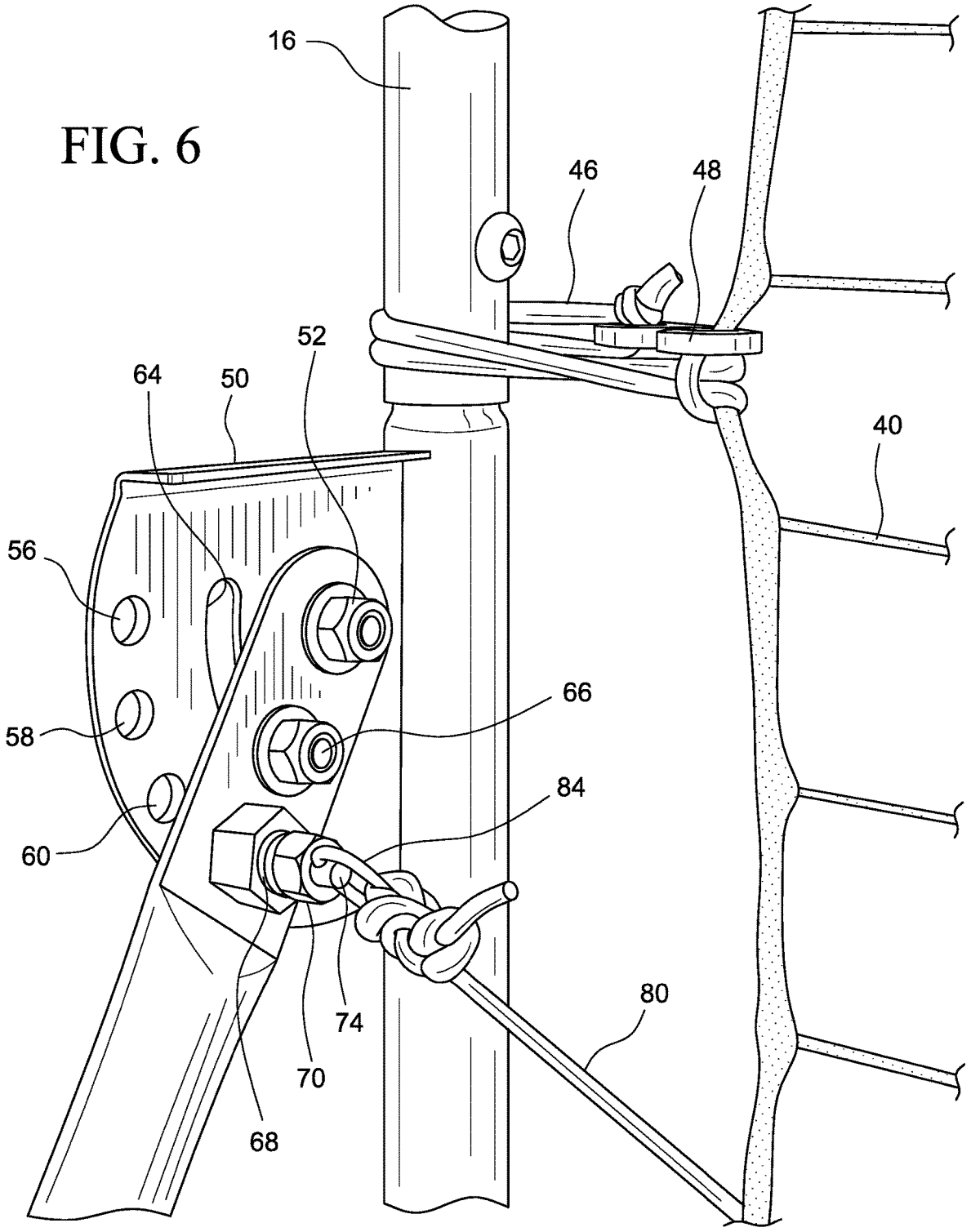
FIG. 6 is an enlarged view of an angular adjustment bracket and plunger with pull cord of the ball rebounding practice net of FIG. 1.
Figure 7:
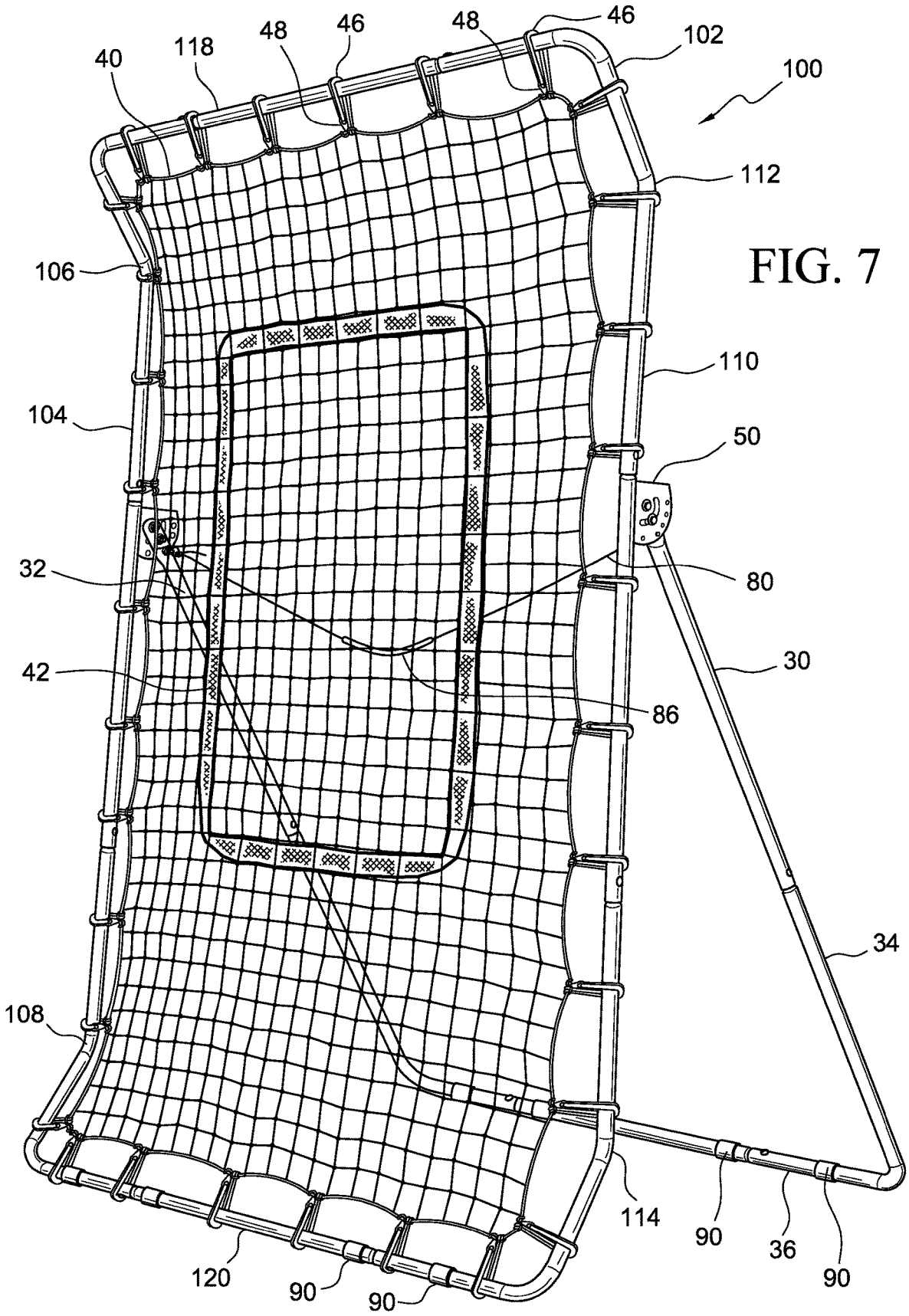
FIG. 7 is a right front perspective view of a ball rebounding practice net of a second embodiment standing at a first angle from vertical.
Figure 8:
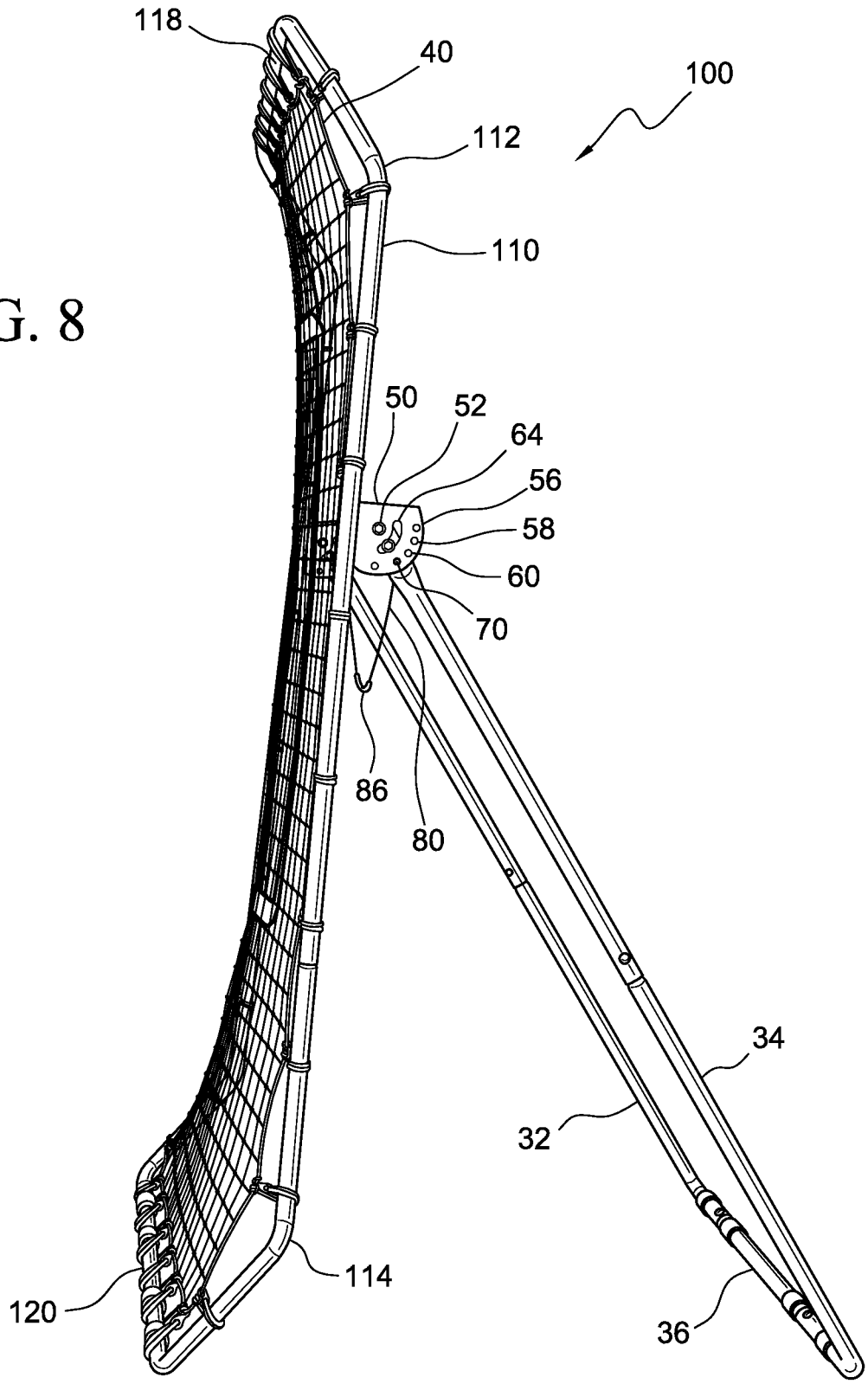
FIG. 8 is a right side elevational view of the ball rebounding practice net of FIG. 7.
Figure 9:
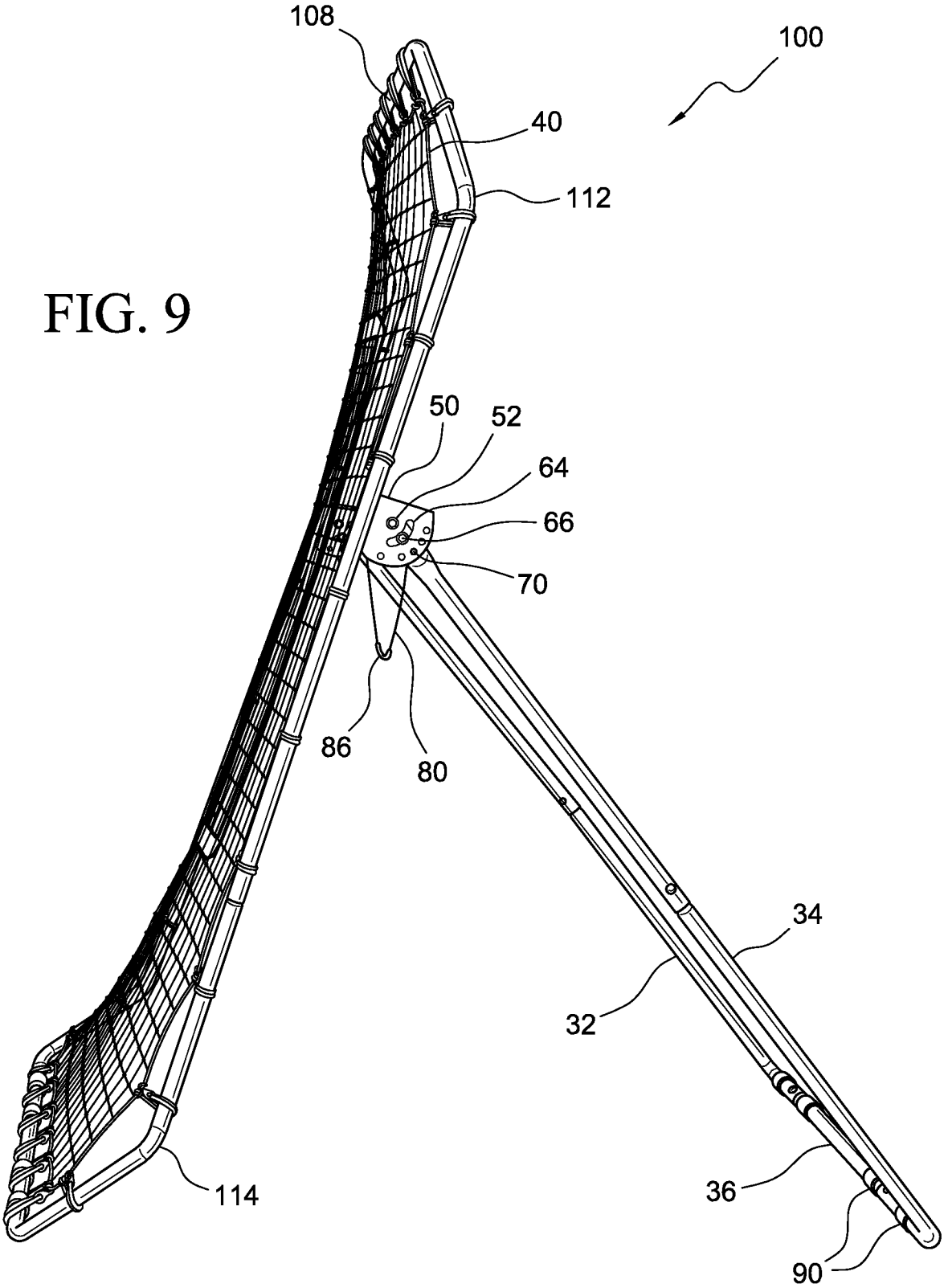
FIG. 9 is a right side elevational view of the ball rebounding practice net of FIG. 7 in which the net surface is held at a second angle from vertical.
Figure 10:
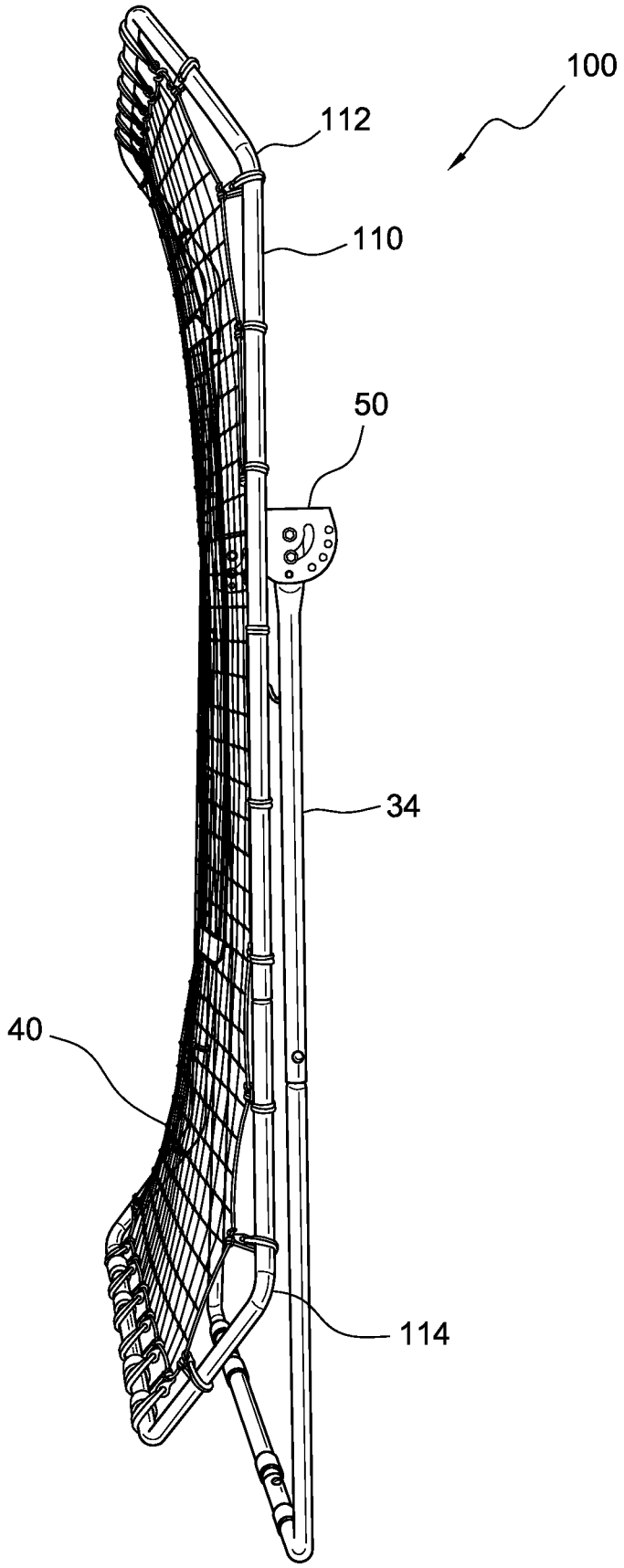
FIG. 10 is a right side elevational view of the ball rebounding practice net of FIG. 7 in which the net surface is held in parallel with the back support in a storage configuration.

Referring to FIG. 6, a plunger 68 associated with each arm 32, 34 of the back support 30 retractably holds a pin 70. The pin 70 is adapted to fit within one of a desired respective hole 56, 58, 60 in the respective five holes in the arcuate array of a bracket 50. A pull cord 80 is attached at one end 82 to a first of the plunger pins 70 and at its opposite end 84 to a second of the plunger pins 70. Optionally, the pull cord 80 has a handle 86 attached to or integrally formed in the pull cord 80 along the length of the cord. The handle 86 may be a separate structure appended to the pull cord 80, or may be woven integrally into the cord 80 as shown in FIGS. 7 and 8. Upon pulling action on the pull cord 80, each plunger 68 retracts its respective pin 70 into the plunger 68 and out of the mating hole 56, 58, 60 of the bracket 50. The user may then establish a different angle between the back support and the net frame and release the cord 80 to allow the pins 70 to seat in different holes 56, 58, 60 in the arcuate array of holes in the brackets 50. The user will hold the top 18 of the frame 12 of the net 40 in one hand and pull the cord 80 with the other using a sharp tug to release the plunger pins 70. The plunger pins 70 default to their released position outside of the plunger 68 when tension is taken off the cord/cord handle 86. The released pins 70 seat in a respective hole and will "click" into place.

Figure 5:
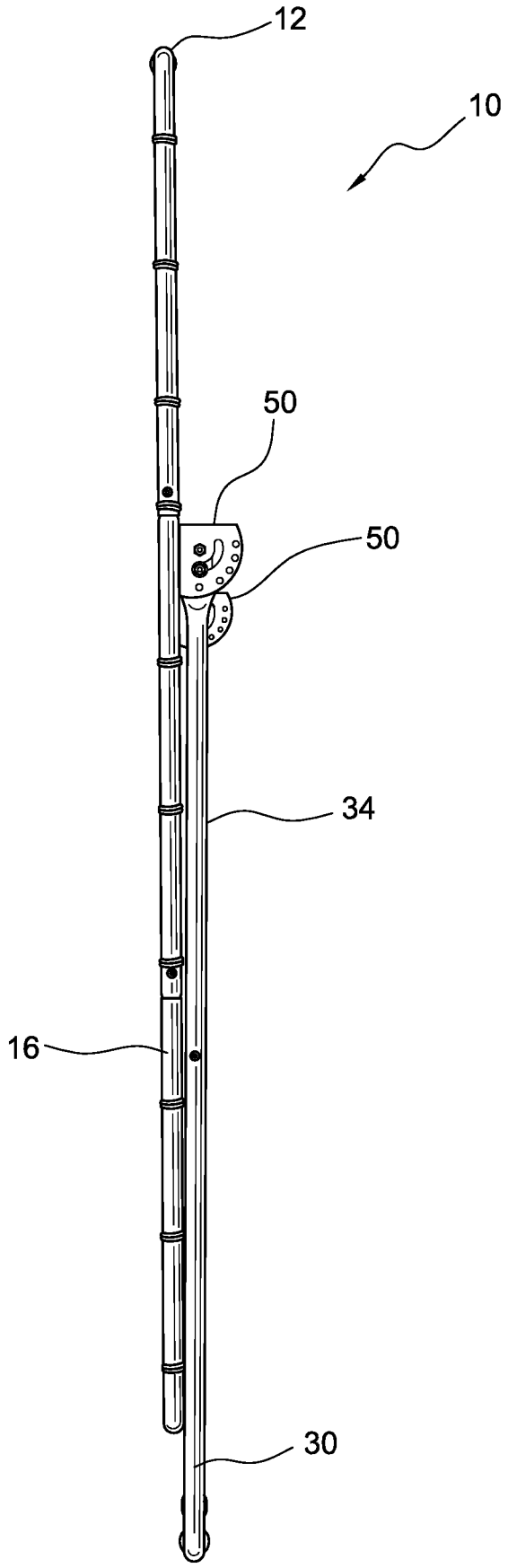
FIG. 5 is a right side elevational view of the ball rebounding practice net of FIG. 1 in which the net surface is held in parallel with the back support in a storage configuration.

The sports ball rebounder net 10 of the embodiment shown has four usable practice angles, and one storage position. A straight up and down position of the net will return a baseball or softball along the ground, e.g. a "grounder". The straight up and down position generally disposes the back support 30 at an angle to the frame 12 of about 30 to about 35 degrees. The middle-angled positions will return the ball directly to the player, e.g., a "line drive". The middle-angled positions generally dispose the back support 30 at an angle to the frame 12 of about 50 to about 80 degrees, or at an angle of about 55 to about 75 degrees. See, e.g., FIGS. 1-3. The last position will return the ball in the air, e.g., a "pop-up". The last position generally disposes the back support 30 at an angle to the frame 12 of about 90 to about 100 degrees, preferably about 97 or 98 degrees. See FIG. 4. The fifth and final hole is for a storage position. See FIG. 5. The rebounder net 10 can be folded and locked into a flat position with the back support 30 and frame 12 generally parallel to one another (FIG. 5).

FIGS. 7-10 show an alternate embodiment of the sports ball rebounder net 100 that has side posts 104, 110 with inwardly directed bends 106, 112 of approximately 30 to 45 degrees near the top of the frame 102 and inwardly directed bends 108, 114 of approximately 30 to 45 degrees near the base 120 of the frame 102. The back support 30 and means for adjusting the angle of the back support 30 using the plunger 68 and pull cord 80 in association with the brackets 50 associated with the side posts 104, 110 of the frame 102 otherwise remain the same as described above in respect of the first embodiment of sports rebounder net 10.

Preferably, the frame 10, 100 is formed of metal tubing held together with carriage bolts. The tubing preferably is 1.2 mm (0.047 inch) thick round tubular galvanized steel. The frame 10, 100 may be formed of any material that can withstand repeated impacts from ball strikes without misshaping the frame. The carriage bolts prevent round tubing from rotating and causing misalignment of the angularly adjustment mechanism.

The plungers 68 generally have an outer housing, a plunger or spring, a pin 70 that screws into the plunger and comes out the backside where an attachment point 74 is located. The attachment point 74 is welded to prevent it from separating from the plunger 68. The respective ends 84 of the pull cord 80 are attached or tied to the attachment point 74. The outer housing and pin 70 preferably are formed of a metal such as stainless steel. The spring 72 inside the plunger 68 generally is a coil spring with a spring force of about 2 to 5 Kg (5.358 lb.-13.39 lb). For example, in one preferred embodiment, when there is no resistance one person needs 2.5 Kg (6.698 lb) force to pull the pin (the person must lift the weight of the rebounder off the pin to remove resistance).

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

I claim:

1. A sports ball rebounder net, comprising:

a frame;

a net suspended within the frame;

a back support adapted to maintain the frame in one or more angles from horizontal over a ground or support surface, said back support having a first arm and a second arm;

a first bracket depending from the frame, said first bracket defining a pivot point and defining two or more holes therethrough spaced apart from the pivot point;

a second bracket depending from the frame, said second bracket defining a pivot point and defining two or more holes therethrough spaced apart from the pivot point;

a first pin associated with the first arm and deployed from a first plunger, said first pin retractably engageable with one of the two or more holes of the first bracket;

a second pin associated with the second arm and deployed from a second plunger, said second pin retractably engageable with one of the two or more holes of the second bracket; and a cord directly or indirectly joined at one end to the first pin and at its opposite end to the second pin, said cord adapted to be pulled to retract the first pin and the second pin out of the holes of the first and second brackets.

2. The sports ball rebounder net of claim 1, wherein the first arm is joined with a fastener for pivotable movement to the pivot point of the first bracket, and the second arm is joined with a fastener for pivotable movement to the pivot point of the second bracket.

3. The sports ball rebounder net of claim 1, wherein the first bracket further defines a first arcuate slot or hole positioned between the first bracket pivot point and the two or more holes of the first bracket, and wherein the second bracket further defines a second arcuate slot or hole positioned between the second bracket pivot point and the two or more holes of the second bracket.

4. The sports ball rebounder net of claim 3, further comprising a first projection or fastener extending from the first arm and into the first arcuate slot or hole, and a second projection or fastener extending from the second arm and into the second arcuate slot or hole.

5. The sports ball rebounder net of claim 1, further comprising a handle on the cord.

6. The sports ball rebounder net of claim 5 wherein the handle is woven integrally into the cord.

7. The sports ball rebounder net of claim 1, wherein the cord is joined at one end to the first plunger and at its opposite end to the second plunger.

8. The sports ball rebounder net of claim 1, wherein the frame has a base, and further comprises one or more frictional engagement bands appended to the base adapted for contact with a ground or support surface.

9. The sports ball rebounder net of claim 1, wherein the back support has a base, and further comprises one or more frictional engagement bands appended to the base adapted for contact with a ground or support surface.

10. The sports ball rebounder net of claim 1, wherein the net is joined to the frame with elastic bands with each elastic band further secured by a hook.

11. The sports ball rebounder net of claim 1, wherein one hole of the two or more holes of the first bracket is for a storage position so that when the first pin is in the one hole of the first bracket the first arm is positioned generally parallel with the frame.

12. A method for adjusting angular orientation of a sports ball rebounder net, comprising:

(a) grasping a frame of the sports ball rebounder net, said sports ball rebounder net having:

the frame, a net suspended from said frame, a first bracket depending from the frame, said first bracket defining a pivot point and defining two or more holes therethrough spaced apart from the pivot point, a second bracket depending from the frame, said second bracket defining a pivot point and defining two or more holes therethrough spaced apart from the pivot point, a back support having a first arm pivotally joined to the first bracket at a first angle and having a second arm pivotally joined to the second bracket at a first angle, a first retractable pin associated with the first arm and deployed from a first plunger, said first retractable pin adapted to engage with one of the two or more holes of the first bracket, a second retractable pin associated with the second arm and deployed from a second plunger, said second retractable pin adapted to engage with one of the two or more holes of the second bracket, a cord directly or indirectly joined at one end to the first pin and at an opposite end to the second pin, said cord adapted to be pulled to retract the first pin and the second pin out of the two or more holes of the first and second brackets;

(b) pulling the cord to concurrently retract the first pin and the second pin; and (c) pivoting the back support to an angle different than the first angle with respect to the frame to set the first pin into another of the two or more holes of the first bracket and to set the second pin into another of the two or more holes of the second bracket.

13. The method of claim 12, wherein said first plunger is welded to the first of the back support arms, and said second plunger is welded to the second of the back support arms.

14. The method of claim 12, wherein the cord further comprises a handle.

15. The method of claim 14, wherein the handle is integrally woven into the cord.

16. The method of claim 12, wherein the first angle is a storage position in which the first arm and second arm are parallel to the frame.

17. The method of claim 12, wherein the second angle is an angle in the range of from about 30 to about 35 degrees.

18. The method of claim 12, wherein the second angle is an angle in the range of from about 50 to about 80 degrees.

19. The method of claim 12, wherein the second angle is an angle in the range of from about 90 to about 100 degrees.

* * * * *